US007735926B1

(12) United States Patent
Combs

(10) Patent No.: US 7,735,926 B1
(45) Date of Patent: Jun. 15, 2010

(54) CHAIR LIFT

(76) Inventor: John A. Combs, 2021 Regency Dr., Wyomissing, PA (US) 19610

( * ) Notice: Subject to any disclaimer, the term of this patent is extended or adjusted under 35 U.S.C. 154(b) by 0 days.

(21) Appl. No.: 12/316,150

(22) Filed: Dec. 9, 2008

(51) Int. Cl.
*A47C 3/32* (2006.01)

(52) U.S. Cl. ..... 297/339; 297/337; 297/DIG. 10

(58) Field of Classification Search ..... 297/313, 297/323, 331, 335, 337, 339, DIG. 10
See application file for complete search history.

(56) References Cited

U.S. PATENT DOCUMENTS

| | | | | | |
|---|---|---|---|---|---|
| 1,379,943 | A | * | 5/1921 | Stevens | 297/339 |
| 3,915,494 | A | * | 10/1975 | Somerset | 297/339 |
| 4,083,599 | A | | 4/1978 | Gaffney | |
| 4,266,468 | A | | 5/1981 | Johnson | |
| 4,690,457 | A | | 9/1987 | Poncy et al. | |
| 4,907,303 | A | * | 3/1990 | Baird | 297/DIG. 10 |
| 4,909,569 | A | | 3/1990 | Gaffney | |
| 4,913,423 | A | | 4/1990 | Farran et al. | |
| 4,929,022 | A | | 5/1990 | Geraci | |
| 4,979,726 | A | | 12/1990 | Geraci | |
| 5,082,327 | A | | 1/1992 | Crisp | |
| 5,094,508 | A | | 3/1992 | Bathrick et al. | |
| 5,294,179 | A | | 3/1994 | Rudes et al. | |
| 5,303,982 | A | * | 4/1994 | Johnston | 297/339 |
| 5,312,153 | A | | 5/1994 | Lin | |
| 5,445,431 | A | * | 8/1995 | Johnston | 297/339 |
| 5,931,532 | A | | 8/1999 | Kemmerer et al. | |
| 6,106,062 | A | | 8/2000 | Ambrose | |
| 6,173,986 | B1 | | 1/2001 | Sicher | |
| 6,213,554 | B1 | | 4/2001 | Marcoux et al. | |
| 7,000,988 | B2 | | 2/2006 | Bresser et al. | |
| 7,021,713 | B2 | | 4/2006 | Kao et al. | |
| 7,090,297 | B2 | | 8/2006 | Mohn et al. | |
| 7,255,397 | B2 | | 8/2007 | Olcheski | |
| 7,434,882 | B1 | * | 10/2008 | Hodges | 297/335 |
| 2006/0260621 | A1 | * | 11/2006 | Agrawal et al. | 128/845 |

* cited by examiner

*Primary Examiner*—Peter R. Brown
(74) *Attorney, Agent, or Firm*—Thomas R. Shaffer

(57) ABSTRACT

A lift chair is provided which includes a frame having four legs and a back rest portion. A seat has a front portion pivotally attached to the frame and has a rear portion which can be lifted upwardly. The seat movable from a first generally horizontal sitting position to a second angled lift position where the rear portion of said seat is lifted upwardly. Arm rests members are movably attached to opposite sides of the frame. Each arm rest member has a generally horizontal arm rest portion and a vertical activating rod member. The arm rests are movable from a first upper vertical position to a second lower vertical position. A rope and pulley system is provided which includes a pulley attached to a lower end of each activating rod and additional pulleys are attached to the frame. A rope is attached to the rear portion of the seat and extends around the pulleys. When a user pushes downwardly on the arm rests, the arm rests together with the rope and pulleys cause the rear portion of said seat to be lifted upwardly thus helping the user to stand up and get out of the chair.

10 Claims, 11 Drawing Sheets

CHAIR LIFT

BACKGROUND OF THE INVENTION

1. Field of the Intention

The present invention relates to a chair lift. More specifically, the present invention relates to a chair which allows a user to push downwardly on arm rests to cause, with the help of ropes and pulleys, a rear portion of said seat to be efficiently lifted upwardly thus helping the user to stand up and get out of the chair.

2. Description of the Prior Art

A variety of lift chair devices have been proposed over the years. A number of existing patents teach the use of an electric screw drive or the like to lift all or a large portion of a chair to assist a user to stand up. Examples of such devices include: Ambrose, Jr. et al., U.S. Pat. No. 6,106,062; Lin, U.S. Pat. No. 5,312,153; Gaffney, U.S. Pat. No. 4,083,599; Mohn et al., U.S. Pat. No. 7,090,297; Gaffney, U.S. Pat. No. 4,909,569; Rudes et al., U.S. Pat. No. 5,294,179; and Kemmerer et al., U.S. Pat. No. 5,931,532.

Marcoux et al., U.S. Pat. No. 6,213,554 provides a lift chair utilizing a piston 96 to tip a chair forward. Kao et al., U.S. Pat. No. 7,021,713 utilizes a telescopic lifter 40 to lift a movable seat portion 22 of a chair.

Bressler et al., U.S. Pat. No. 7,000,988 discloses a lift chair which utilizes biasing means preferably in the form of gas springs 80 to lift a chair (see FIG. 2). The gas springs can be placed in various locations.

Crisp, U.S. Pat. No. 5,082,327 discloses a lift apparatus for use with a chair which provides a number of torsion springs 46 which tend to spread the upper and lower frame members apart from each other. The number of springs and their spring rates may be varied to provide the proper lift for a given weight range of intended users.

Geraci, U.S. Pat. No. 4,979,726 provides a chair having a lift apparatus which uses a spring operated lever assembly 26. Geraci, U.S. Pat. No. 4,929,022 provides a lift chair wherein the user steps on a foot rest, pulls rearwardly on hand gripped levers and springs assist the user in standing up (see FIG. 2).

Bathrick et al., U.S. Pat. No. 5,094,508 discloses an elevator chair which includes a vertically telescopic back frame which is raised and lowered by a motor driven screw and tube assembly. As shown in FIG. 1 rear legs 30 and 31 are telescopically disposed in rear square frame tubes 18 and 19.

Poncy et al., U.S. Pat. No. 4,690,457 discloses a chair with a lift assist mechanism which utilizes a pneumatic cylinder 34 to lift a seat frame 11 and cushion 12 by manipulating a control lever 50.

Farran et al., U.S. Pat. No. 4,913,423 discloses a chair which includes a cable 74 and plural pulleys 71 and 72 (FIG. 3) along the sides of the chair which are used for exercise purposes.

Other devices of general interest include Olcheski, U.S. Pat. No. 7,255,397 (infrared sensing chair lift); Johnson, U.S. Pat. No. 4,266,468 (wall clearing recliner); and Sicher, U.S. Pat. No. 6,173,986 (rowing arms driven wheel chair).

There remains a need for a lift chair which is inexpensive to produce and which does not require external power, lift cylinders, springs, screw jacks or other biasing means. There also remains a need for a lift chair which efficiently utilizes the natural force of a user pushing downwardly on the arms of a chair to provide a vertical lift on the seat of a chair.

SUMMARY OF THE INVENTION

Many senior citizens, older adults and persons with disabilities have difficulty standing up from a seated position. It is common for such individuals to use table tops to push their bodies upward, or to push downwardly on their legs as they raise their bodies from a seated position. After considering this problem, careful observation has revealed that in almost every case when such individuals tried to get up they would push down on their legs, the sides or arms of the chair or on the surface of the table. These observations can be summarized that people pushed down to stand up.

Studies have shown that when going from being seated to a standing position, people start the process by utilizing their hip muscles followed by the use of the thigh and knee muscles as they raise their bodies. When standing up, nearly all of the stress is put on the legs. Unfortunately, the elderly struggle because the specific muscles used for this process tend to get weaker as they age. Most individuals tend to use muscles less and less over time as we grow older. This causes muscles to atrophy (decrease in size) over time if they are not used. In addition, arthritis is the number one major chronic health condition for elderly Americans. These are the primary reasons why so many seniors have trouble standing up from chairs. Because elderly persons have trouble lowering and raising their bodies into and out of chairs, many products are on the market but they tend to be expensive, heavy and bulky. Because many elderly persons have modest income levels and many others are impoverished, there is a clear need for an inexpensive solution to this simple daily task.

Some of the positive attributes of a chair which are preferably incorporated into the present invention include a high back (to take weight off the lower spine); high, wide and slightly sloped armrests which allow the user to push themselves up and which ease pressure on the arms; comfort; and a sloping waterfall front seat edge (to reduce pressure on the user's legs and to ensure better circulation). The chair should also be lightweight, affordable and convenient.

In its simplest form the present invention provides a lift chair comprising:

a) a frame having a plurality of legs and a back rest portion;

b) a seat having a front portion pivotally attached to said frame and having a rear portion, said seat movable from a first generally horizontal sitting position to a second angled lift position wherein said rear portion of said seat is lifted upwardly;

c) arm rests members movably attached to opposite sides of said frame, each arm rest member having a generally horizontal arm rest portion and a vertical activating rod member attached to said arm rest portion, said arm rests movable from a first upper vertical position to a second lower vertical position; and d) rope and pulley means including a pulley attached to a lower end of each activating rod and plural pulleys attached to said frame with a rope attached to said rear portion of said seat, said rope extended around said pulleys whereby pushing downwardly on said arm rests causes said arm rests to move from said a first upper vertical position to said second lower vertical position which causes said rear portion of said seat to move from a first generally horizontal sitting position to said second angled lift position.

Preferably, each of the legs have a vertical arm rest chamber therein and each arm rest member has at least one attachment post whereby each arm rest post is telescopically received in an arm rest chamber. Preferably, a pair of front legs and a pair of rear legs are provided. Preferably, said plural pulleys attached to said frame include, on each opposite side of said frame, a pulley on a front leg, a pulley on a rear leg and a pair of pulleys on said back rest portion.

Preferably, said rear portion of said seat further comprises a pair of rear extension members and a rear seat pulley attachment rod extending between said rear extension members.

Preferably, said rear extension portion members extend through and slide upwardly and downwardly in slots provided in said back rest portion.

Preferably, said pulley means includes at least five pulleys but may in two embodiments include at least six pulleys. It will be obvious to those of ordinary skill in the art that the choice of more pulleys provides a greater mechanical advantage but requires a further travel of the arm rest to achieve the same degree of lifting of the rear seat portion. Some of the rope and pulley means shown in the drawings can be described as follows: In the preferred embodiment shown in FIG. 5A said front pulley is attached to said front leg, said rear pulley is attached to said rear leg, said first back pulley is attached to a middle portion of said back rest portion and said second back pulley is attached to an upper portion of said back rest portion and wherein said first rope end extends away from said rod portion and extends around said front pulley, said rear pulley, said first back pulley, said second back pulley and is attached to said rear portion of said seat and wherein said second rope end extends away from said rod portion and extends around said rear pulley, said front pulley, said first back pulley, said second back pulley and is attached to said rear portion of said seat. In the embodiment shown in FIG. 5C said front pulley is attached to said front leg, said rear pulley is attached to said rear leg, said first back pulley is attached to a middle portion of said back rest portion and said second back pulley is attached to an upper portion of said back rest portion and wherein said first rope end extends away from said rod portion and extends around said front pulley, said rear pulley, said first back pulley, said second back pulley, said auxiliary pulley and is attached to said rear portion of said seat and wherein said second rope end extends away from said rod portion and extends around said rear pulley, said front pulley, said first back pulley, said second back pulley, said auxiliary pulley and is attached to said rear portion of said seat. In the embodiment shown in FIG. 6D said front pulley is attached to said front leg, said rear pulley is attached to said rear lea, said first back pulley is attached to a middle portion of said back rest portion and said second back pulley is attached to an upper portion of said back rest portion and wherein said first rope end extends away from said rod portion and extends around said front pulley and wherein said second rope end extends away from said rod portion and extends around said rear pulley, said first back pulley and said second back pulley. In the embodiment shown in FIG. 6C said front pulley is attached to said front leg, said rear pulley is attached to said rear leg, said first back pulley is attached to a middle portion of said back rest portion and said second back pulley is attached to an upper portion of said back rest portion and wherein said front pulley is attached to said front leg, said rear pulley is attached to said rear leg, said first back pulley attached to a middle portion of said back rest portion and a second back pulley attached to an upper portion of said back rest portion and wherein said first rope end extends away from said rod portion and extends around said front pulley, said first back pulley, said second back pulley and wherein said second rope end extends away from said rod portion and extends around said rear pulley, said first back pulley and said second back pulley. In the embodiment shown in FIG. 6E said front pulley is attached to said front leg, said rear pulley is attached to said rear leg, said first back pulley is attached to a middle portion of said back rest portion and said second back pulley is attached to an upper portion of said back rest portion and wherein said first rope end extends away from said rod portion and extends around said front pulley, said rear pulley, said first back pulley and said second back pulley and wherein said second rope end extends away from said rod portion and extends around said rear pulley, said first back pulley and said second back pulley. Finally, in the embodiment shown in FIG. 5B said front pulley is attached to said front leg, said rear pulley is attached to said rear leg, said first back pulley is attached to a lower portion of said back rest portion and a second back pulley is attached to an middle portion of said back rest portion and wherein said first rope end extends away from said rod portion and extends around said front pulley, said rear pulley, said first back pulley, said back second pulley, said auxiliary pulley and is attached to a front portion of said seat and wherein said second rope end extends away from said rod portion and extends around said rear pulley, said front pulley, said first back pulley, said second back pulley said auxiliary pulley and is attached to a front portion of said seat. Preferably, a rope and pulley means is provided on each side of said frame and each rope and pulley means is enclosed under a cover. As used in this application, the term "rope" is to be defined broadly and includes any type or form of rope, cable, wire, cord or string or any other flexible elongated member which may be effectively used with pulleys.

DETAILED DESCRIPTION OF THE PREFERRED EMBODIMENTS

Figure 1:
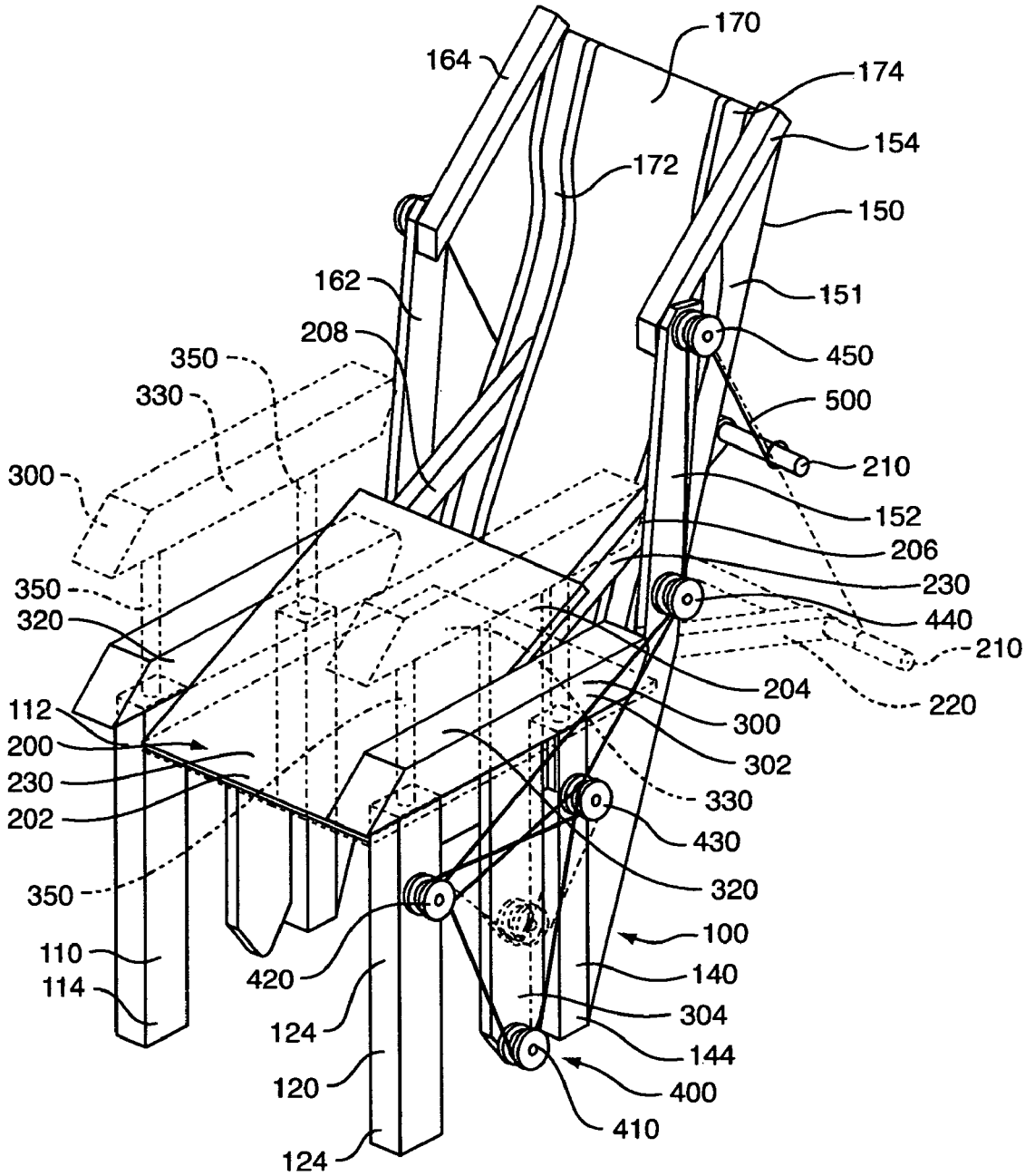
FIG. 1 is a perspective view of the lift chair of the present invention with the arm rests in a second lower vertical position and the seat in a second angled lift position and also showing, in chain line, the arm rests in a first upper vertical position and the seat in a first horizontal sitting position.

Referring to FIG. 1 the lift chair of the present invention has a frame 100 which includes legs 110, 120, 130 and 140 and a back rest portion 150. A seat 200 has a front portion 202 which is pivotally attached to said frame at 205 (FIG. 8) and has a rear portion 204. The seat 200 movable from a first generally horizontal sitting position 220 (FIG. 7) to a second angled lift position 230 (FIG. 8) wherein the rear portion 204 of said seat 200 is lifted upwardly. Arm rest members 300 are movably attached to opposite sides of said frame 100. Each arm rest member 300 has a generally horizontal arm rest portion 302 and a vertical activating rod member 304 attached to said arm rest portion 302. The arm rests 300 are movable from a first upper vertical position 330 (FIG. 7) to a second lower vertical position 320 (FIG. 8). A rope and pulley means 400 including a rod pulley 410 attached to a lower end of each activating rod 304 and plural pulleys including front pulley 420 attached to front leg 120, rear pulley 430 attached to rear leg 140, a first back pulley 440 attached to back rest portion 150 and a second back pulley 450 attached back rest portion 150, all of said pulleys attached to said frame 100 with a rope 500 attached to said rear portion 210 of said seat 200. The rope 500 extends around the pulleys 410, 420, 430, 440 and 450 whereby pushing downwardly on said arm rests 300 causes said arm rests to move from said a first upper vertical position 330 to said second lower vertical position 320 which causes said rear portion 204 of said seat 200 to move from a first generally horizontal sitting position 220 to said second angled lift position 230.

The legs 110, 120, 130 and 140 each have a vertical arm rest chamber or channel 124 therein and each arm rest member 300 has at least one and preferably two attachment posts 350 therein whereby each arm rest post 350 is telescopically received in an arm rest chamber 124. This allows the arm rest 300 to slide upwardly and downwardly relative the frame (in the legs) in a smooth guided manner. The vertical arm rest chambers are drilled or otherwise provided into the upper ends 112, 122, 132 and 142 of legs 110, 120, 130 and 140, respectively. The chair rests on the floor or ground in lower ends 114, 124, 134 and 144 of said legs.

The legs include a pair of front legs 110 and 120 and a pair or rear legs 130 and 140. Plural pulleys are attached to the frame 100 and preferably include, on each opposite side of said frame, a pulley 420 on a front leg 120, a pulley 430 on a rear leg 140 and a pair of pulleys 440 and 450 on said back rest portion 150.

The rear portion 204 of the seat 200 further comprises a pair of rear extension members 206 and 208 and a rear seat pulley attachment rod 210 extending between said rear extension arms 206 and 208. As shown, the rear extension members 206 and 208 extend through and slide upwardly and downwardly in slots 174 and 172, respectively, provided in said back rest portion 150.

The rope and pulley means 400 preferably includes at least five pulleys, such as pulleys 410 (rod), 420 (front), 430 (rear), 440 (first back) and 450 (second back). In one embodiment the rope and pulley means 400 can include at least six pulleys, such as pulleys 410 (rod), 420 (front), 430 (rear), 452 (first back), 460 (second back) and 470 (auxiliary) as shown in (FIG. 5B or such as pulleys 410, 420, 430, 440, 450, and auxiliary pulley 455 as shown in FIG. 5C. To prevent possible injury or having a user getting caught in the rope and pulley means 400 any suitable cover or guide (not shown) is preferably placed over the rope and pulley means on each side of the frame 100.

In FIG. 1, the lift chair of the present invention is shown with the arm rests 300 in a second lower vertical position 320 and the seat in a second angled lift position 230. FIG. 1 also shows however, in chain line, the arm rests 300 in a first upper vertical position 330 and the seat in a first horizontal sitting position 220.

Figure 2:
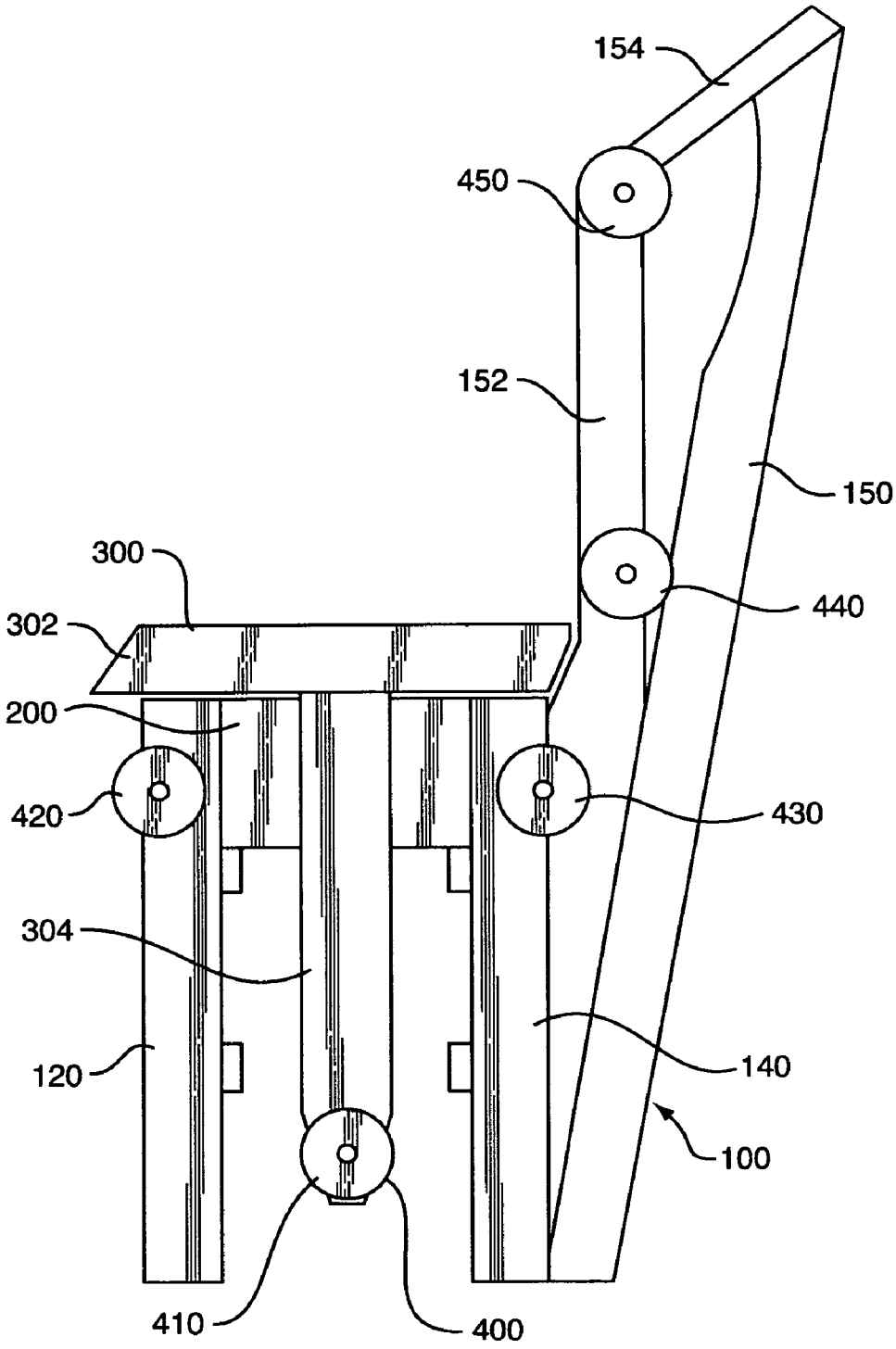
FIG. 2 is a side elevation view showing an arm rest in the second down position.

The back rest portion 150 of the frame 100 has frame members 151, 152 and 154 on one side and members 161 (not shown) 162 and 164 on an opposite side. The back rest portion 150 has a large central back portion 170 which is located between the grooves 172 and 174 in which the rear seat extensions 208 and 206 extend. Some of these back rest portion members are also shown in FIG. 2.

Figure 3B:
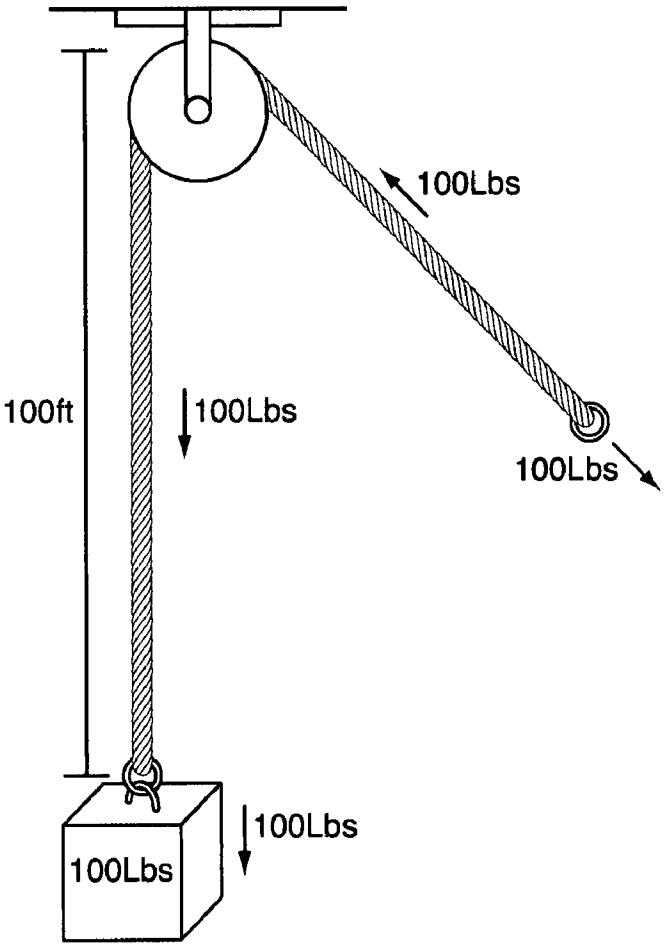
FIGS. 3A, 3B, 3C and 3D show various arrangements of pulleys and show the mechanical advantage of adding additional pulleys.
Figure 3A:
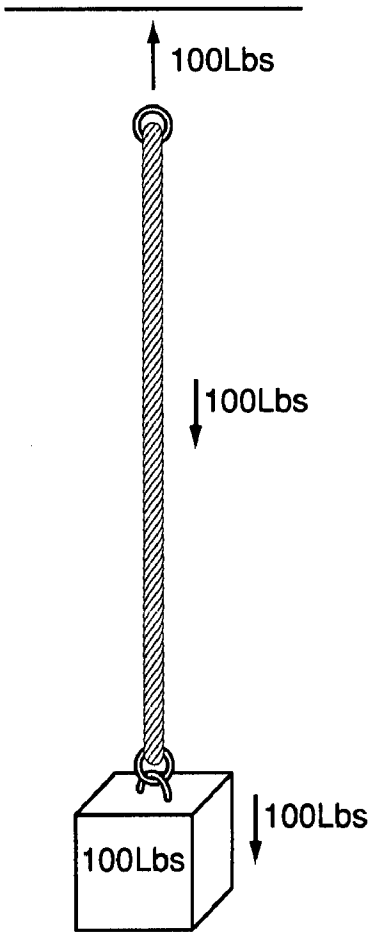
Figure 3C:
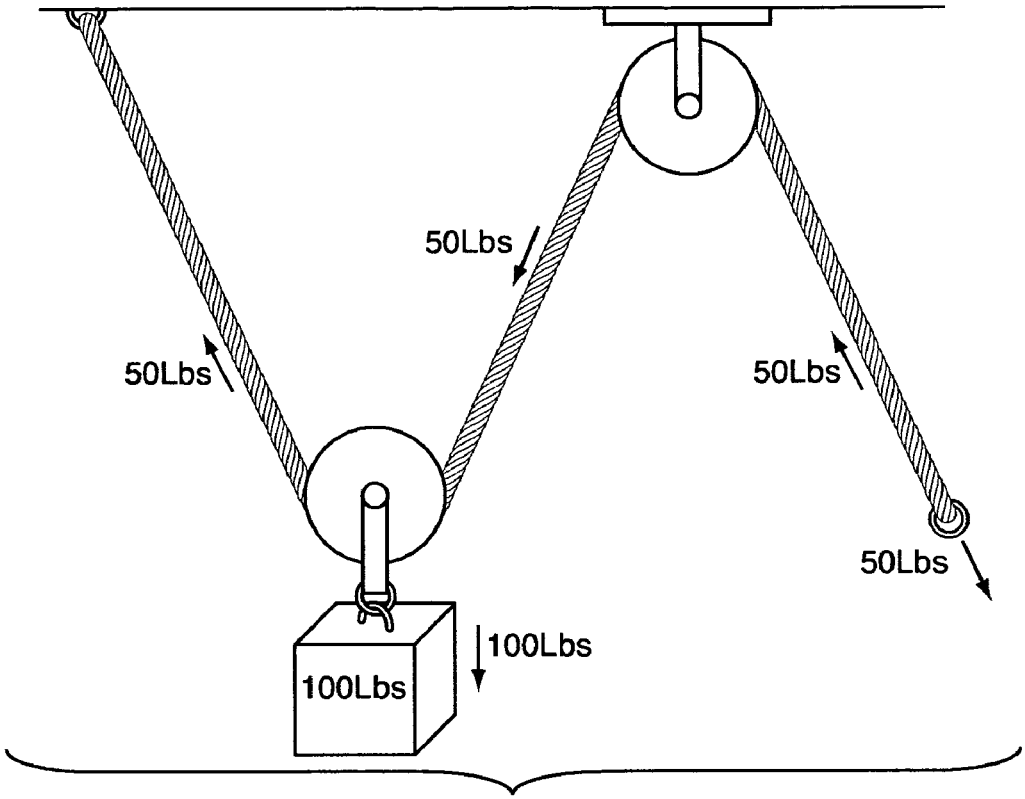
Figure 3D:
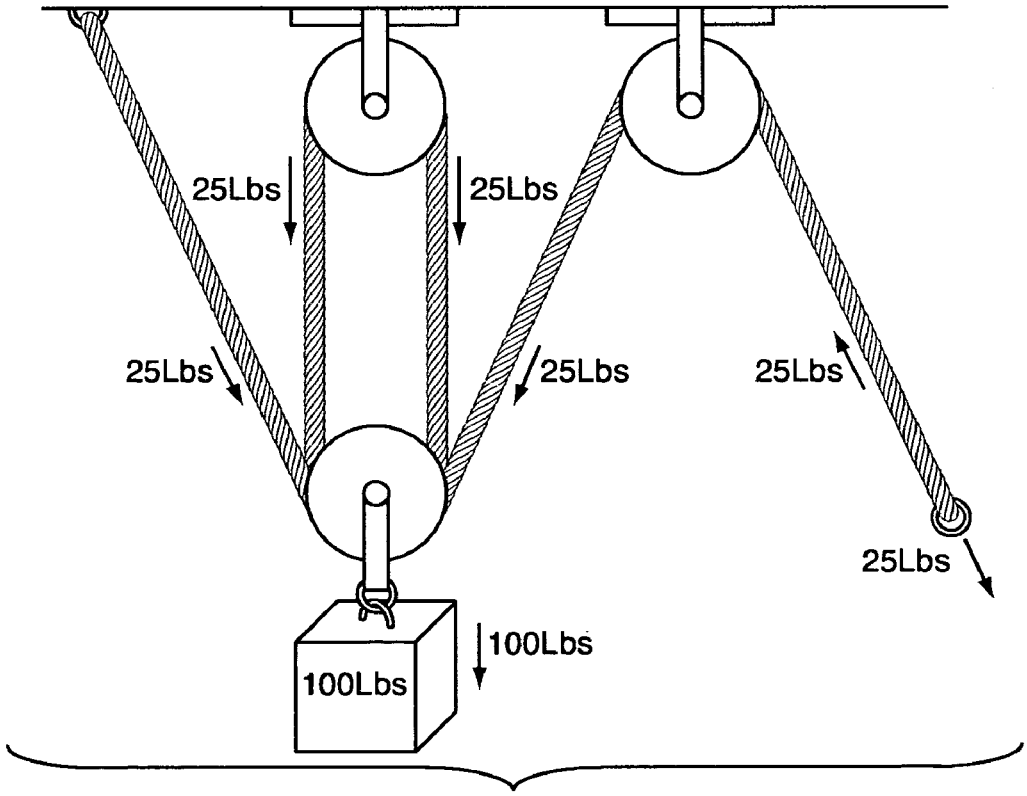

As is well known in the art, FIGS. 3A, 3B, 3C and 3D show various arrangements of pulleys and show the mechanical advantage of adding additional pulleys. For example with only one pulley (FIG. 3B) no mechanical advantage is obtained but only a change in direction in the force applied. FIG. 3C shows the use of two pulleys to lift a 100 pound weight with only 50 pounds of force required. Similarly, FIG. 3D shows the use of three pulleys to lift a 100 pound weight with only 25 pounds of force required.

Figure 4:
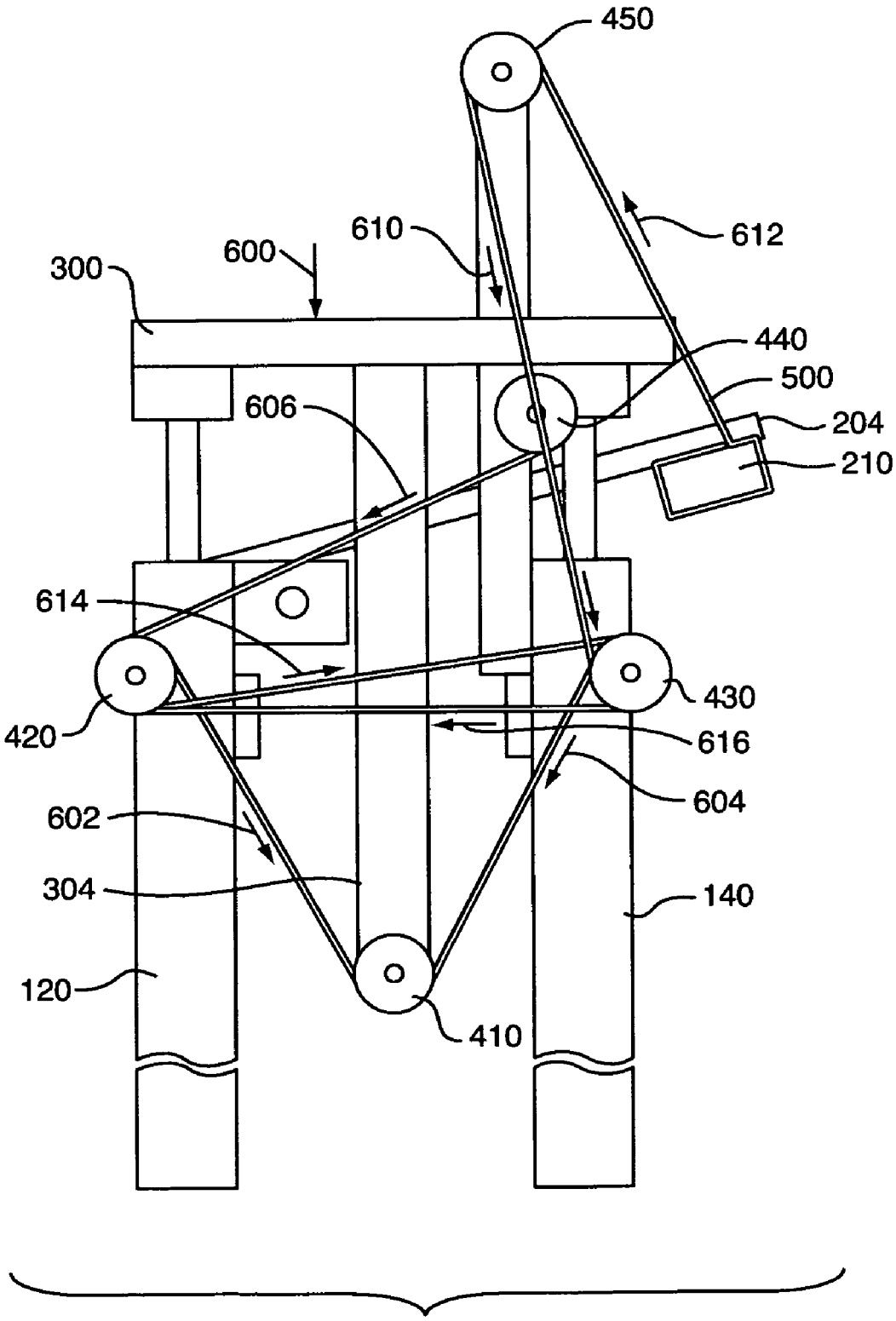
FIG. 4 is a side elevation view showing the presently preferred arrangement of pulleys and the direction of movement of the rope at various locations when a downward force is placed on an arm rest.

FIG. 4 shows the direction the rope 500 is moving at various locations as the arm rest 300 is pressed downwardly in the direction of arrow 600. Such action forced vertical activation rod 304 downwardly thus casing the rope 500 to move downwardly at arrows 602, 604, 606, 608 and 610. This in turn causes the rope 500 to move upwardly at arrow 612 lifting the rear portion 204, 210 of seat in the manner previously described.

Figure 5A:
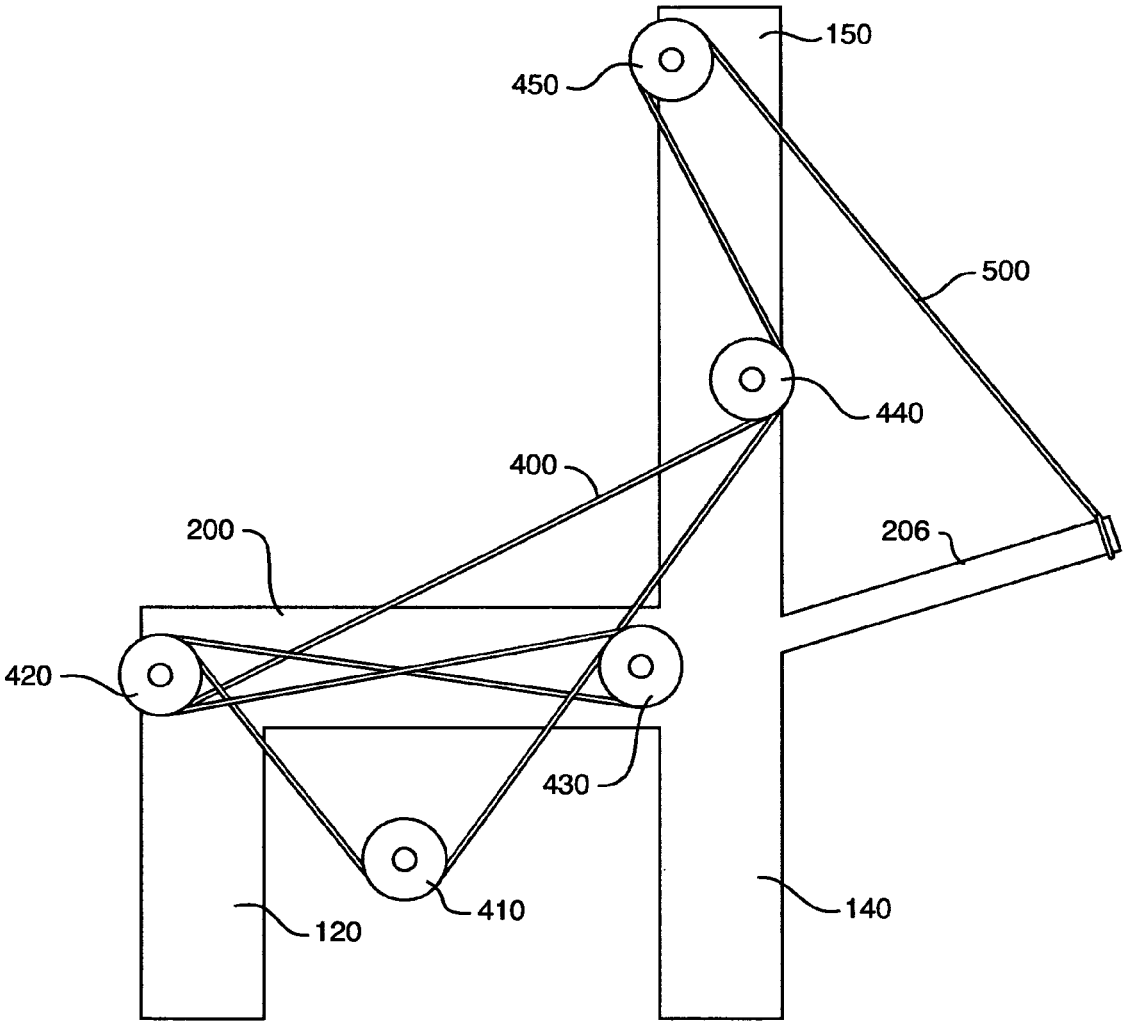
FIG. 5A is a schematic view of the preferred pulley arrangement on a chair.
Figure 5B:
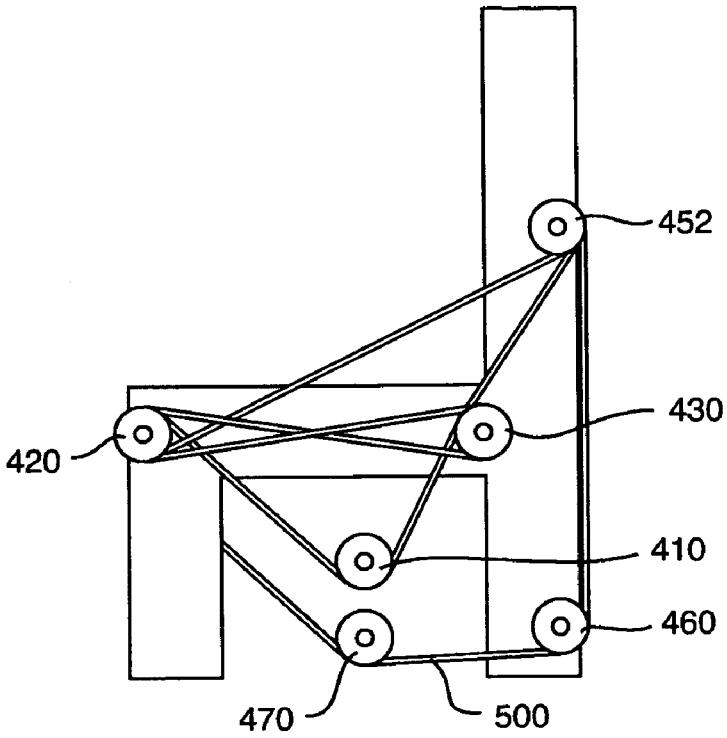
FIG. 5B is a schematic view of an alternative pulley arrangement on a chair.
Figure 5C:
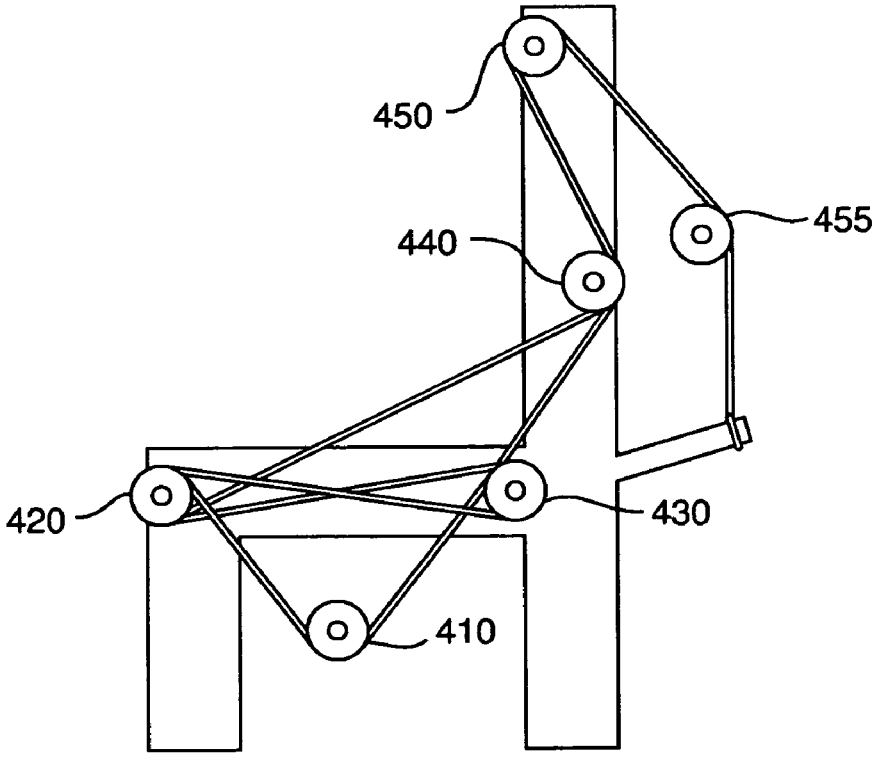
FIG. 5C is a schematic view of yet another pulley arrangement on a chair.
Figure 6A:
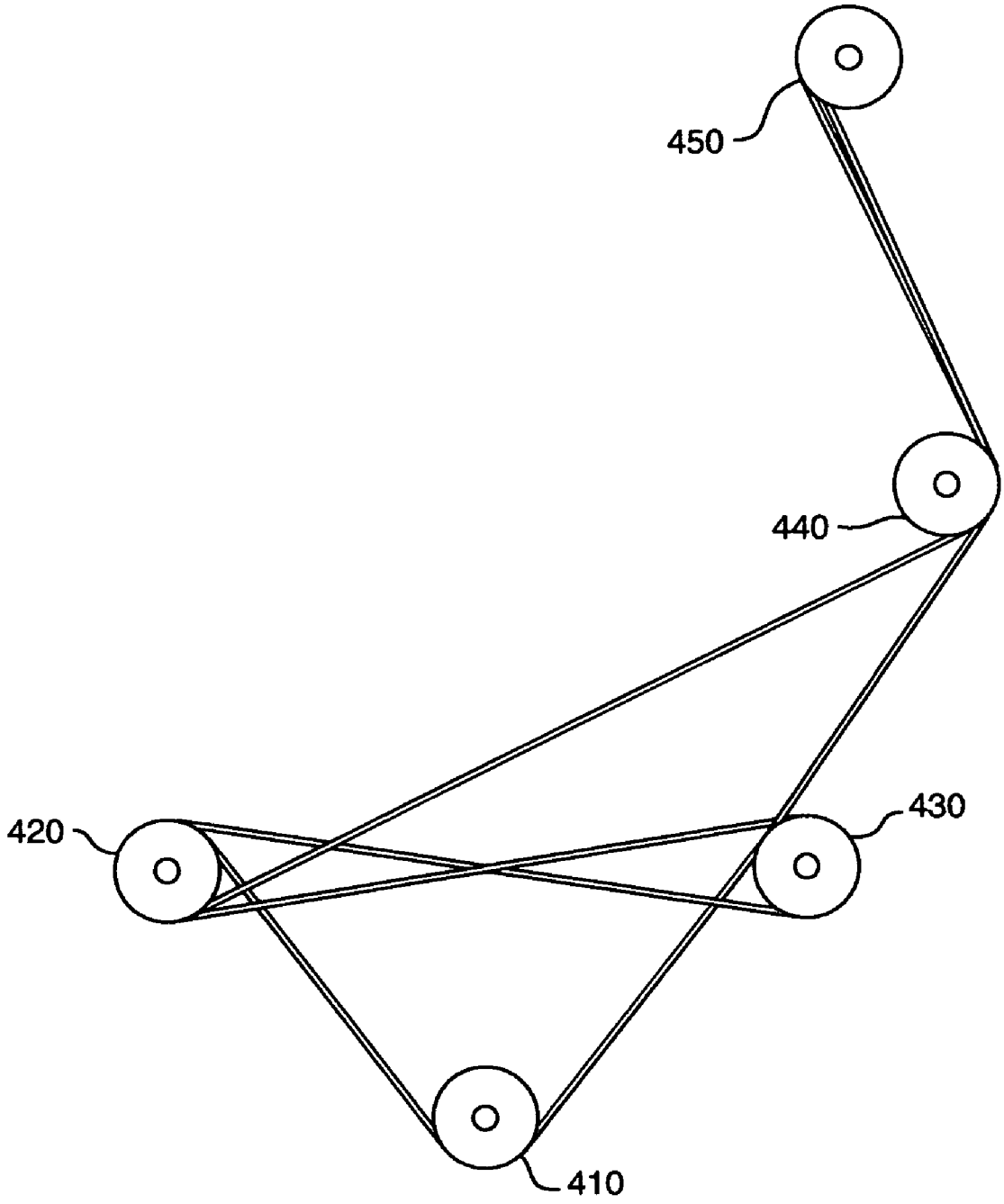
FIGS. 6A, 6B, 6C, 6D and 6E are schematic views of various pulley arrangements with five pulleys arranged in the same basic layout but with different size pulleys and with different configurations of rope interconnections.
Figure 6B:
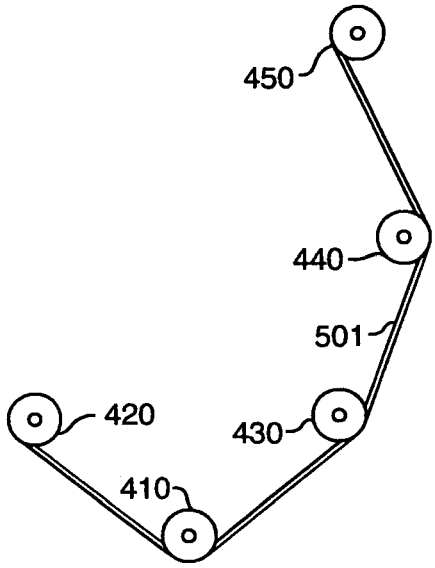
Figure 6C:
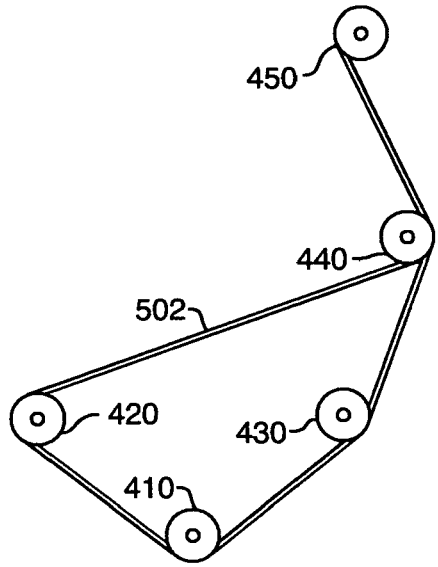
Figure 6D:
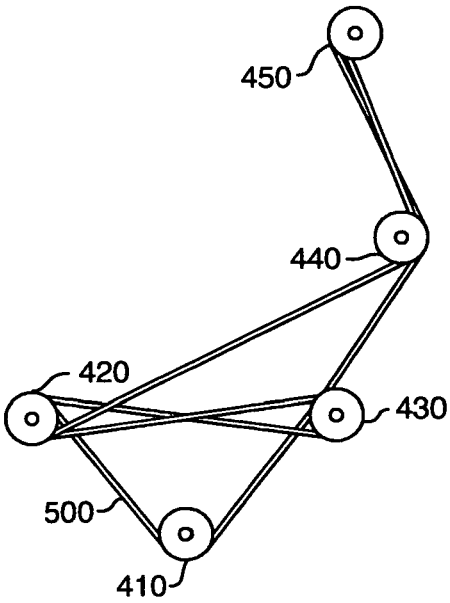
Figure 6E:
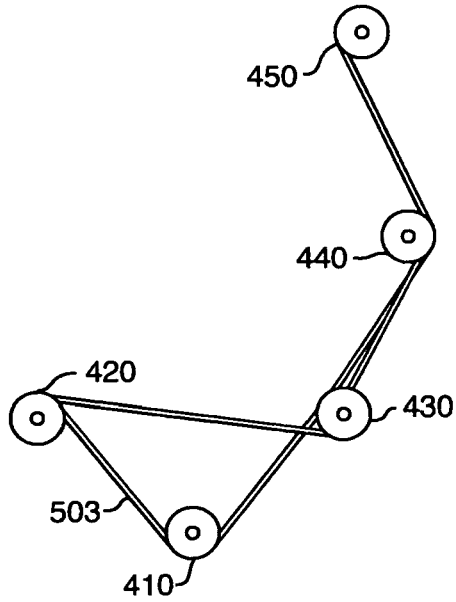

FIGS. 5A, 5B, 5C, 6A, 6B, 6C, 6D and 6E show various pulley and rope configurations and variations which will be well understood by those of skill in the art. In FIGS. 5A, 6A, 6B, 6C, 6D, and 6E, a rod pulley 410, a front pulley 420, a rear pulley 430, a first back pulley 440 and a second back pulley 450 are provided as shown. In FIG. 5B, the first back pulley is labeled 452 and an auxiliary pulley 470 is added. In FIG. 5C, an auxiliary pulley 455 is added. In FIG. 5A, first rope end of rope 500 extends away from said rod portion and extends around said front pulley 420, said rear pulley 430, said first back pulley 440, said second back pulley 450 and is attached to said rear portion 206 of said seat and wherein said second rope end extends away from said rod portion and extends around said rear pulley 430, said front pulley 420, said first back pulley 440, said second back pulley 450 and is attached to said rear portion 206 of said seat. FIG. 5C shows a similar arrangement with an auxiliary pulley 455 added. As previously described, various other arrangements for the rope and pulley means are shown in the other Figures.

Figure 7:
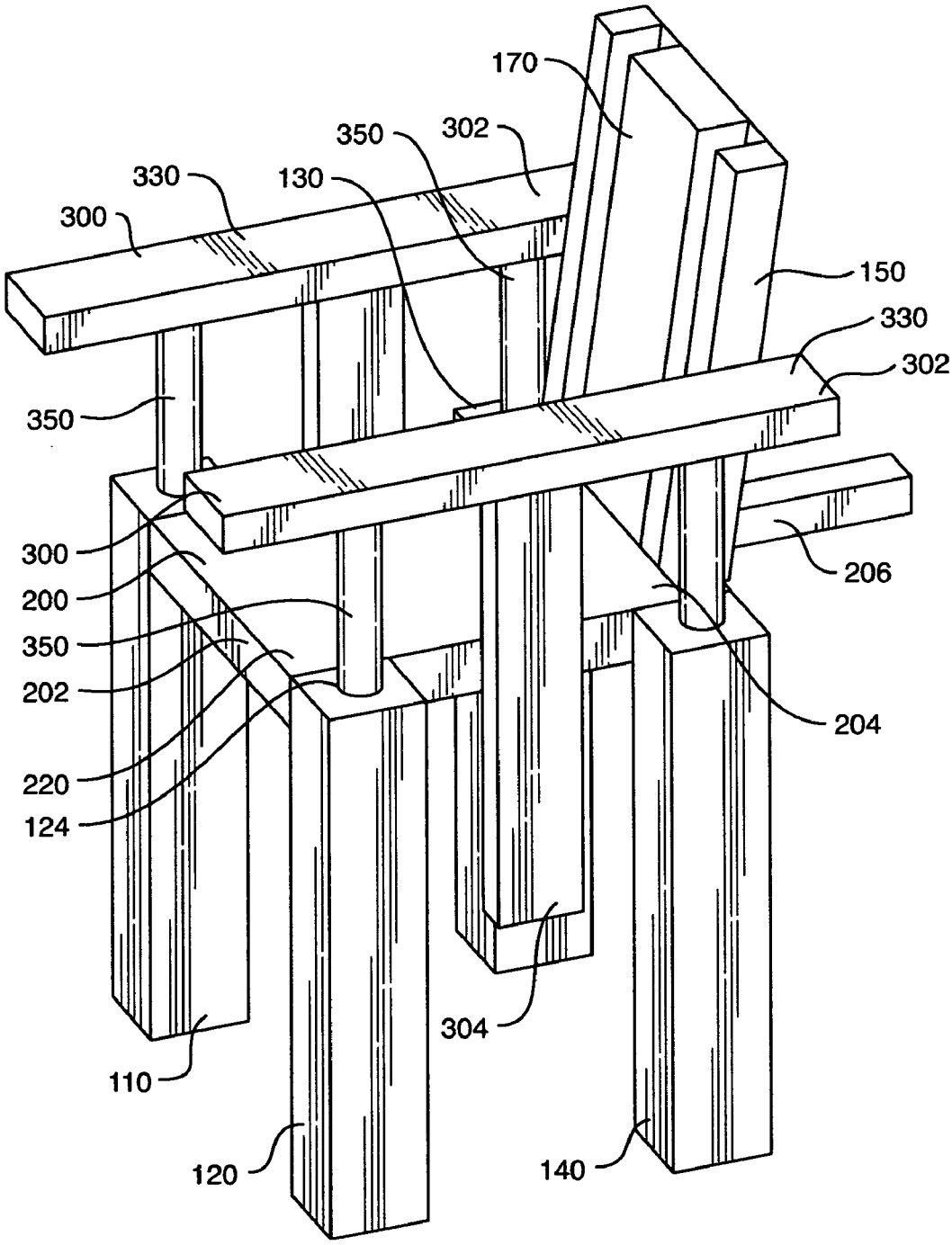
FIG. 7 is a perspective view of a lift chair according to the present invention (pulleys not shown) in a normal sitting position with the arm rests in a first upper vertical position and the seat in a first horizontal sitting position.
Figure 8:
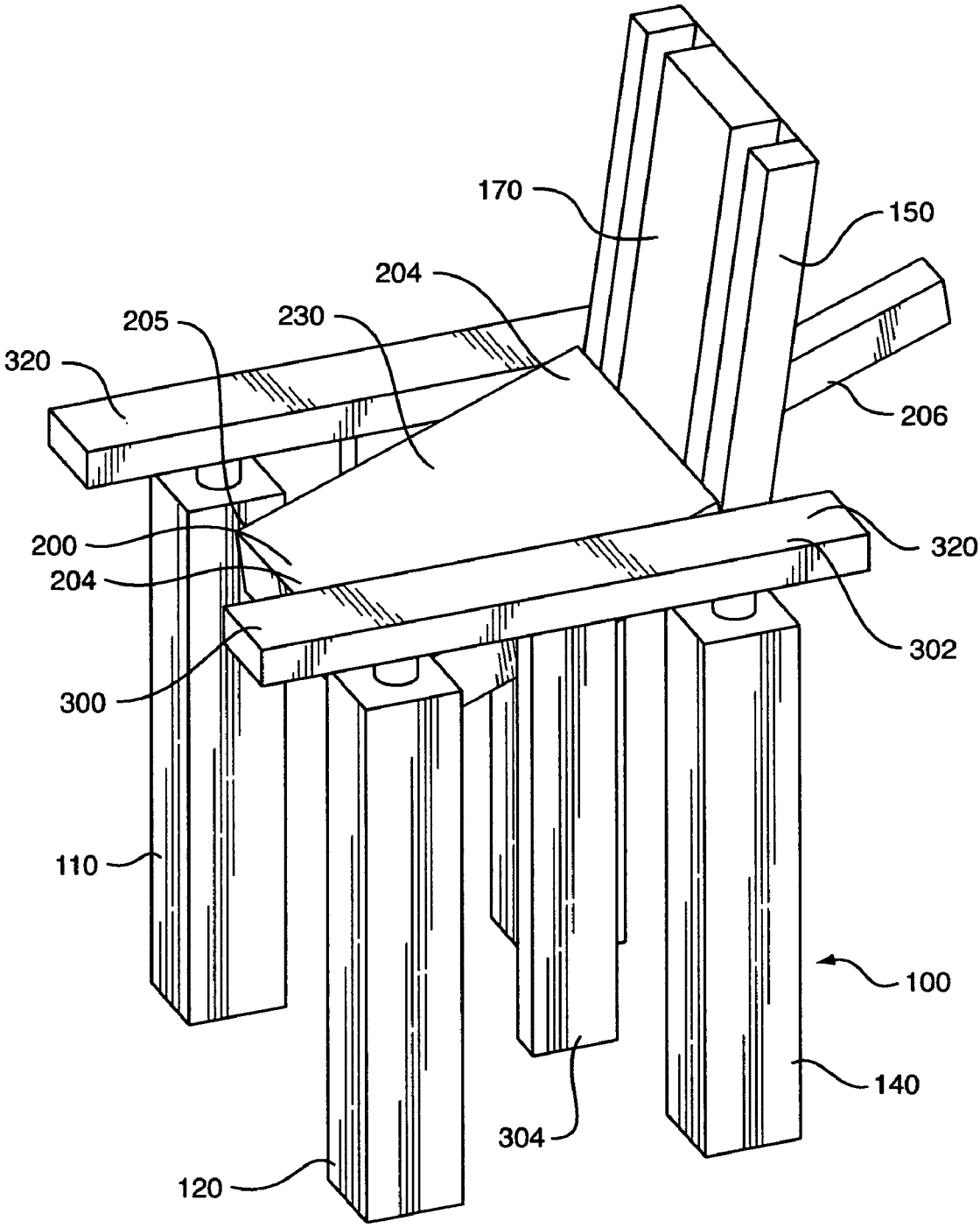
FIG. 8 is a perspective view of a lift chair according to the present invention (pulleys not shown) in a raised assist position with the arm rests pushed down to a second lower vertical position and the rear of the seat in a second angled lift position.

FIG. 7 shows seat 200 in its first generally horizontal sitting position 220. The arm rests 300 are shown in a first upper vertical position 330. FIG. 8 also shows more clearly that each arm rest post 350 is telescopically received in an arm rest chamber 124. It is to be understood that various techniques and methods can be utilized to reduce friction as the arm rest posts 350 slide into and out of the chambers 124 in the legs. For example, drawer slides could be utilized with elongated slide tracks being placed into each chamber 124 with rollers (which travel smoothly in said slide tracks) mounted on said arm rest posts. Various other types of drawer slides or ball bearing slides can be used to reduce friction so that more of the downward force on the arm rests 300 results as a lifting force.

FIG. 8 shows the seat 200 in a second angled lift position 230 wherein the rear portion 204 of said seat 200 is lifted upwardly. The arm rests 300 are in a second lower vertical position 320. In FIG. 8 the arm rest posts 350 are completely received within the chamber 124 in the legs 110, 120, 130 and 140 of frame 100.

In operation, the present invention is amazingly simple because it is designed to utilize the normal motion which a user typically engages in to get out of a chair. The user simple pushes down on the arm rests 300 and the rope and pulley means 400 provides an enormous mechanical advantage and allows the user to far more easily reach a standing position.

The various components of the present invention can be fabricated from any suitable materials such a wood, plastic or metal.

It is to be understood that while certain forms of the present invention have been illustrated and described herein, the present invention is not to be limited to the specific forms or arrangements of parts described and shown.

I claim:

1. A lift chair comprising:

a) a frame having opposite sides and having a plurality of legs, said legs including a front leg and a rear leg on each opposite side, and said frame having a back rest portion;

b) a seat having a front portion pivotally attached to said frame and having a rear portion, said seat movable from a first generally horizontal sitting position to a second angled lift position wherein said rear portion of said seat is lifted upwardly;

c) arm rest members movably attached to opposite sides of said frame, each arm rest member having a generally horizontal arm rest portion and a vertical activating rod member attached to said arm rest portion, said arm rests movable from a first upper vertical position to a second lower vertical position; and d) rope and pulley means on each of said opposite sides including a rod pulley attached to said activating rod member and a plurality of pulleys attached to said frame each spaced apart from one another including, a front pulley, a rear pulley, a first back pulley and a second back pulley and a rope, said rope having a rod portion located between a first rope end and a second rope end, said rod portion extending around said rod pulley and said rope extending around said plurality of pulleys and said rope attached to said seat whereby pushing downwardly on said arm rests causes said arm rests to move from said first upper vertical position to said second lower vertical position which causes said seat to move from a first generally horizontal sitting position to said second angled lift position.

2. A lift chair according to claim 1 wherein said plurality of legs each have a vertical arm rest chamber therein and each arm rest member has at least one attachment post whereby each arm rest post is telescopically received in an arm rest chamber, said vertical arm rest chamber and said arm rest attachment post each being located parallel to and spaced apart from said vertical activating rod members.

3. A lift chair according to claim 1 wherein said rear portion of said seat further comprises a pair of rear extension members and a rear seat pulley attachment rod extending between said rear extension arms.

4. A lift chair according to claim 3 wherein said rear extension portion members extend through and slide upwardly and downwardly in slots provided in said back rest portion.

5. A chair lift according to claim 1 wherein said front pulley is attached to said front leg, said rear pulley is attached to said rear leg, said first back pulley is attached to a middle portion of said back rest portion and said second back pulley is attached to an upper portion of said back rest portion and wherein said first rope end extends away from said rod portion and extends around said front pulley, said rear pulley, said first back pulley, said second back pulley and is attached to said rear portion of said seat and wherein said second rope end extends away from said rod portion and extends around said rear pulley, said front pulley, said first back pulley, said second back pulley and is attached to said rear portion of said seat.

6. A chair lift according to claim 1 wherein said front pulley is attached to said front leg, said rear pulley is attached to said rear leg, said first back pulley is attached to a middle portion of said back rest portion and said second back pulley is attached to an upper portion of said back rest portion and wherein said first rope end extends away from said rod portion and extends around said front pulley, said rear pulley, said first back pulley, said second back pulley, said auxiliary pulley and is attached to said rear portion of said seat and wherein said second rope end extends away from said rod portion and extends around said rear pulley, said front pulley, said first back pulley, said second back pulley, said auxiliary pulley and is attached to said rear portion of said seat.

7. A chair lift according to claim 1 wherein said front pulley is attached to said front leg, said rear pulley is attached to said rear leg, said first back pulley is attached to a middle portion of said back rest portion and said second back pulley is attached to an upper portion of said back rest portion and wherein said first rope end extends away from said rod portion and extends around said front pulley and wherein said second rope end extends away from said rod portion and extends around said rear pulley, said first back pulley and said second back pulley.

8. A chair lift according to claim 1 wherein said front pulley is attached to said front leg, said rear pulley is attached to said rear leg, said first back pulley is attached to a middle portion of said back rest portion and said second back pulley is attached to an upper portion of said back rest portion and wherein said front pulley is attached to said front leg, said rear pulley is attached to said rear leg, said first back pulley attached to a middle portion of said back rest portion and a second back pulley attached to an upper portion of said back rest portion and wherein said first rope end extends away from said rod portion and extends around said front pulley, said first back pulley, said second back pulley and wherein said second rope end extends away from said rod portion and extends around said rear pulley, said first back pulley and said second back pulley.

9. A chair lift according to claim 1 wherein said front pulley is attached to said front leg, said rear pulley is attached to said rear leg, said first back pulley is attached to a middle portion of said back rest portion and said second back pulley is attached to an upper portion of said back rest portion and wherein said first rope end extends away from said rod portion and extends around said front pulley, said rear pulley, said first back pulley and said second back pulley and wherein said second rope end extends away from said rod portion and extends around said rear pulley, said first back pulley and said second back pulley.

10. A chair lift according to claim 1 wherein said front pulley is attached to said front leg, said rear pulley is attached to said rear leg, said first back pulley is attached to a lower portion of said back rest portion and a second back pulley is attached to an middle portion of said back rest portion and wherein said first rope end extends away from said rod portion and extends around said front pulley, said rear pulley, said first back pulley, said back second pulley, said auxiliary pulley and is attached to a front portion of said seat and wherein said second rope end extends away from said rod portion and extends around said rear pulley, said front pulley, said first back pulley, said second back pulley, said auxiliary pulley and is attached to a front portion of said seat.

* * * * *